US011569638B2

(12) United States Patent
Nishikawa

(10) Patent No.: US 11,569,638 B2
(45) Date of Patent: Jan. 31, 2023

(54) IGNITION PLUG

(71) Applicant: DENSO CORPORATION, Kariya (JP)

(72) Inventor: Shogo Nishikawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/855,934

(22) Filed: Jul. 1, 2022

(65) Prior Publication Data

US 2023/0006427 A1 Jan. 5, 2023

(30) Foreign Application Priority Data

Jul. 5, 2021 (JP) ..... JP2021-111263

(51) Int. Cl.
*H01T 13/36* (2006.01)
*H01T 13/34* (2006.01)

(52) U.S. Cl.
CPC ..... *H01T 13/34* (2013.01); *H01T 13/36* (2013.01)

(58) Field of Classification Search
CPC ..... H01T 13/36
USPC ..... 313/141
See application file for complete search history.

(56) References Cited

U.S. PATENT DOCUMENTS

| | | | | |
|---|---|---|---|---|
| 6,414,420 | B1 | 7/2002 | Suzuki | |
| 9,166,376 | B2 * | 10/2015 | Kyuno | H01T 13/36 |
| 10,978,556 | B2 * | 4/2021 | He | H01L 21/76805 |
| 2004/0222728 | A1 * | 11/2004 | Suzuki | H01T 13/36 313/132 |
| 2005/0104497 | A1 * | 5/2005 | Fischer | H01T 13/36 313/144 |
| 2006/0022556 | A1 * | 2/2006 | Bail | H03H 9/0552 310/344 |
| 2013/0307403 | A1 * | 11/2013 | Henke | H01T 13/36 313/144 |
| 2021/0036491 | A1 * | 2/2021 | Kawashima | H01T 13/36 |
| 2021/0151958 | A1 * | 5/2021 | Herzberg | H01T 13/36 |

FOREIGN PATENT DOCUMENTS

DE 102005034886 A1 * 2/2006 ..... H01T 13/36

* cited by examiner

*Primary Examiner* — Christopher M Raabe
(74) *Attorney, Agent, or Firm* — Nixon & Vanderhye P.C.

(57) ABSTRACT

An ignition plug includes: an insulator provided with a shaft hole formed therein; a metal fitting caulked to support the insulator from an outer periphery side thereof; and a talc material filled in an annular space provided between an outer peripheral surface of the insulator and an inner peripheral surface of the metal fitting. A first annular member and a second annular member are provided at an end portion of the annular space, the end portion being positioned in a center electrode side along the center axis in the annular space, the second annular member is in contact with the first annular member from an opposite side of the center electrode.

7 Claims, 8 Drawing Sheets

IGNITION PLUG

CROSS-REFERENCE TO RELATED APPLICATION

This application is based on and claims the benefit of priority from earlier Japanese Patent Application No. 2021-111263 filed Jul. 5, 2021, the description of which is incorporated herein by reference.

BACKGROUND

Technical Field

The present disclosure relates to an ignition plug.

Description of the Related Art

An internal combustion engine of a vehicle is provided with an ignition plug for igniting a fuel therein. The ignition plug includes an insulator that supports a center electrode and a metal fitting (i.e. housing) that supports the insulator from outside thereof. The metal fitting is fastened and fixed to the internal combustion engine. A connection part is provided on a side surface of the metal fitting, which allows a tool such as a plug wrench to be engaged thereto when the ignition plug is attached to the internal combustion engine.

SUMMARY

The present disclosure provides an ignition plug capable of suppressing deformation of the metal fitting.

An ignition plug according to the present disclosure incudes: an insulator provided with a shaft hole formed therein; a center electrode supported by the insulator at an one end portion of the shaft hole along a center axis thereof; a metal fitting caulked to support the insulator from an outer periphery side thereof; a ground electrode extending from the metal fitting, a part of the ground electrode facing the center electrode; and a talc material filled in an annular space provided between an outer peripheral surface of the insulator and an inner peripheral surface of the metal fitting.

DETAILED DESCRIPTION OF THE PREFERRED EMBODIMENTS

Figure 1:
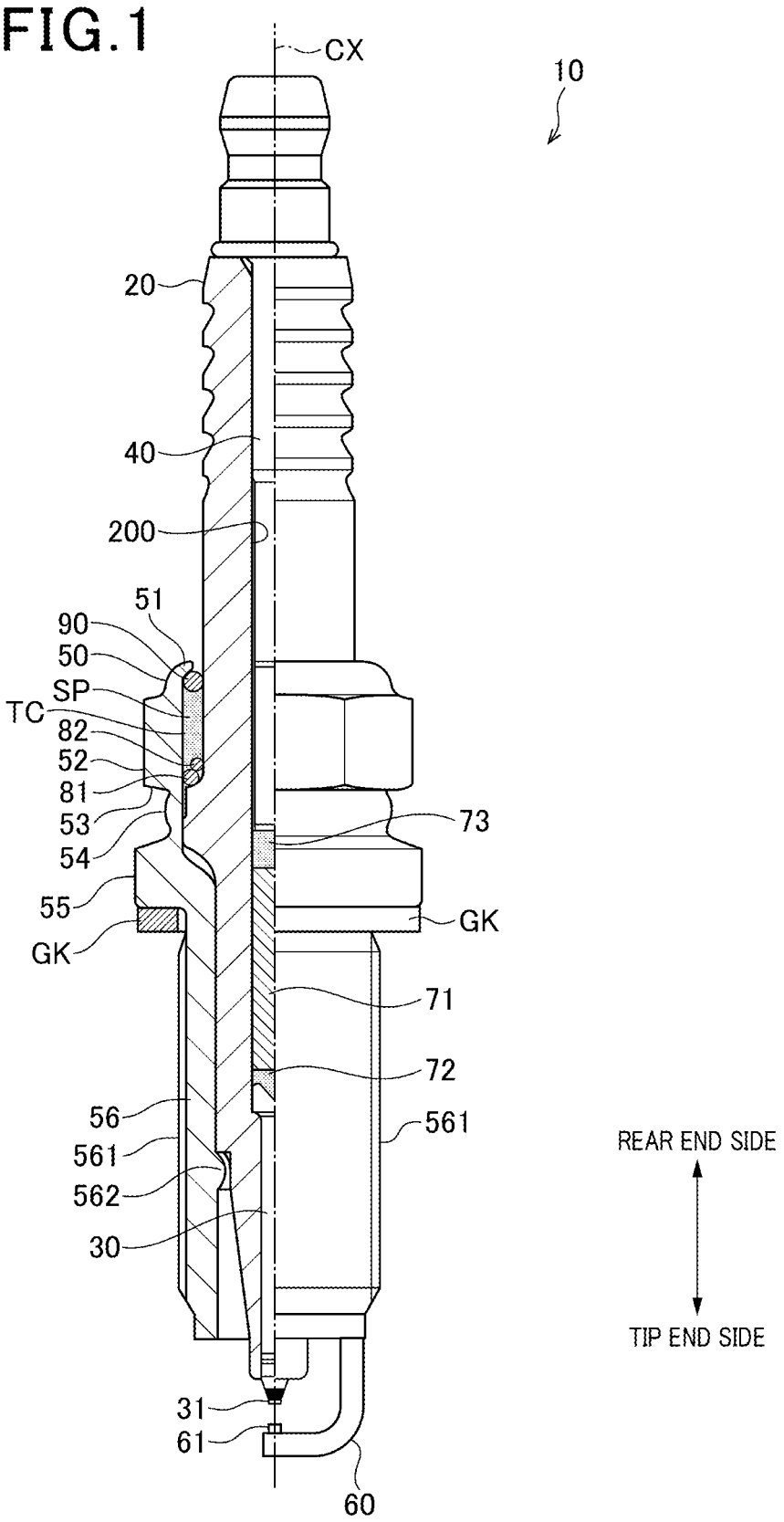
FIG. 1 is a diagram illustrating an internal configuration of an ignition plug according to the present embodiment.

An internal combustion engine of a vehicle is provided with an ignition plug for igniting a fuel therein. The ignition plug includes an insulator that supports a center electrode and a metal fitting (i.e. housing) that supports the insulator from outside thereof. The metal fitting is fastened and fixed to the internal combustion engine. A connection part is provided on a side surface of the metal fitting, which allows a tool such as a plug wrench to be engaged thereto when the ignition plug is attached to the internal combustion engine.

Japanese Patent No. 3502936 discloses an ignition plug having an annular space positioned between the outer peripheral surface of the insulator and the inner peripheral surface of the metal fitting inside the above-mentioned connection part. A talc material which is powdered talcum is filled into the annular space. The talc material is utilized to enhance anti-shock properties of the ignition plug while the internal combustion engine is operating and to prevent the gas from the internal combustion engine from leaking to the outside. In the annular space, annular-shaped members are provided at both portions along a center axis of the ignition plug to support the talc material in the annular space.

In the manufacturing of the ignition plug, the metal fitting is fastened to the insulator in a state where the talc material and a pair of annular members are accommodated in the annular space. At this moment, the talc material thereinside is compressed. The metal fitting receives force from the compressed talc material in a direction expanding outward.

In recent years, the ignition coil is required to be smaller because of space restriction in the vicinity of the internal combustion engine due to arrangement of the components. Hence, a two-face width in the connection part, that is, the width between two faces which face each other in the connection part, becomes smaller compared to that of conventional art. In the case where the two-face width is small, since the thickness of the connection part becomes small, the metal fitting is likely to be deformed due to the force of the talc material.

In the case where the connection part of the metal fitting is deformed, it may be difficult to engage with a tool when attaching the ignition plug to the internal combustion engine. Further, deformation of the metal fitting lowers the sealing performance of the talc material, which may cause external leaking of the gas from the internal combustion engine through the talc material.

The above-mentioned patent literature, Japanese Patent No. 3502936, discloses that dimension such as length and thickness of the annular space where the talc material is filled is defined so as to suppress deformation of the metal fitting due to the force applied from the talc material. However, according to a result of experiment conducted by the inventers of the present disclosure, it is found that it is difficult to sufficiently prevent deformation of the metal fitting using only the configuration disclosed in the above-described patent literature.

The inventors of the present disclosure have found a fact that the annular member to which force is applied by the talc material applies force to the metal fitting to be expanded outward depending on the shape of the insulator, whereby the metal fitting is further deformed. In this regard, the above-described patent literature does not suggest or mention suppressing of the deformation of the metal fitting caused by the force transmitted through the annular member.

With reference to the drawings, the present embodiment will be described. In order to facilitate understanding, for the same constituents in each drawings, the same reference numbers are applied as much as possible and duplicated explanation will be omitted.

With reference to FIG. 1, a configuration of an ignition plug according to the present embodiment will be described. In FIG. 1, the ignition plug 10 is illustrated in which a cross section sectioned along a surface including a center axis CX described later is shown on the left side in FIG. 1. For a center electrode 30 and a terminal fitting 40 among components that constitute the ignition plug 10, each outline is shown without showing a cross section.

The ignition plug 10 is provided at each cylinder in the internal combustion engine which is not shown, and ignites air-fuel mixture in the combustion chamber of each cylinder. The ignition plug 10 is provided with an insulator 20, a center electrode 30, a terminal fitting 40, a metal fitting 50 and a ground electrode 60.

The insulator 20 is a cylindrical member formed of an insulation material such as alumina. In the insulator 20, a shaft hole 200 is formed. The shaft hole 200 is configured as a through hole penetrating through the insulator 20 along the center axis thereof. The center axis of the shaft hole 200 corresponds to the center axis of the insulator 20. Hereinafter, the center axis of the shaft hole 200 is also referred to as center axis CX. When the insulator 20 is sectioned along a line perpendicular to the center axis CX, a cross sectional shape of the shaft hole 200 is circular shape.

The center electrode 30 is made of metal and supported by the insulator 20 at an one end portion along the center axis CX (end portion in the lower side in FIG. 1) of the shaft hole 200. The center electrode 30 is a stick-shaped member and the most part thereof is arranged inside the shaft hole 200. A part of the center electrode 30 protrudes outside the insulator 20 from the shaft hole 200 and a discharge chip 31 is attached to a tip end of the portion protruded from the shaft hole 200.

The terminal fitting 40 is a metallic member and supported by a glass or the like inside the insulator 200 at a second end portion (end portion in the upper side in FIG. 1) of the shaft hole 200 in the center axis CX. The terminal fitting 40 is a stick-shaped member and the most part thereof is arranged inside the shaft hole 200. A part of the terminal fitting 40 protrudes outside the insulator 20. This protruded portion serves as an electrode terminal to which voltage is applied from external power supply which is not shown.

In the insulator 20, a region in which the center electrode 30 is attached along the center axis CX may be referred to as tip end side. Also, in the insulator 20, a region in which the terminal fitting 40 is attached along the center axis CX may be referred to as rear end side.

A resistor 71 is provided between the terminal fitting 40 and the center electrode 30 in the shaft hole 200. The resistor 71 is provided for adjusting an electrical resistance of an electrical path from the terminal fitting 40 to the center electrode. The resistor 71 is made of a material in which a predetermined amount of carbon powder is added to powdered glass and zirconia. The electrical resistance of the resistor 71 is adjusted by an amount of addition of the carbon. The resistor 71 is provided at the electrical path between the terminal fitting 40 and the center electrode 30, thereby suppressing electromagnetic noise accompanied by a spark discharge of the ignition plug 10. The resistor 71 and the center electrode 30 are electrically connected via a conductive sealing layer 72. Similarly, the terminal fitting 40 and the resistor 71 are electrically connected via the conductive sealing layer 73. Each of the conductive sealing layers 72 and 73 is a conductive layer formed of a material in which copper powder is added to the powdered glass.

The metal fitting 50 is configured as a cylindrical member provided to cover a part of the insulator 20 from an outer periphery side thereof. For the metal fitting 50, the entire body is made of metal. As will be described later, the metal fitting 50 is fixed to the insulator 20 by caulking and supports the insulator 20. The metal fitting 50 includes a connection part 52, flange portion 55 and an insertion portion 56.

The connection part 52 is a portion to be engaged with a tool such as a plug wrench when the ignition plug 10 is attached to the internal combustion engine. The shape of the connection part 52 is hexagonal when viewed along the center axis CX. According to the present embodiment, in the connection part 52, width between two faces which face with each other (two face width) is 16 mm. Note that the connection part 52 may have a Bi-HEX shape when viewed from the center axis CX.

The flange portion 55 comes into contact with an outer surface of the internal combustion engine via a gasket GK when the ignition plug 10 is attached to the internal combustion engine. The flange portion 55 is provided in a tip end side than the connection part 52 is positioned, and protrudes towards outer periphery side. A deformation portion 54 is provided between the flange portion 55 and the connection part 52, which will be described later.

The insertion portion 56 is provided a tip end side than the flange portion 55 is positioned, and is to be inserted to an insertion hole (not shown) formed in the internal combustion engine. A male screw is formed on the outer peripheral surface of the insertion portion 56. When the ignition plug 10 is attached to the internal combustion engine, the connection part 52 rotates around the center axis CX with the force applied by the tool. Thus, a female screw formed on the inner peripheral surface of the above-described insertion hole and the male screw 561 of the insertion portion 56 are engaged with each other. With this, the ignition plug 10 is fastened and fixed to the internal combustion engine. In a state where the ignition plug 10 is attached to the internal combustion engine, the electrical potential of the metal fitting 50 is ground potential which is the same as that of the internal combustion engine.

The ground electrode 60 is made of metal and formed extending from an end portion in the tip end side of the metal fitting 50 to further tip end side. The ground electrode 60 is bent and a part thereof faces, along the center axis CX, the discharge chip 31 of the center electrode 30. A ground side chip 61 is attached to a portion facing the discharge chip 31 of the ground electrode 60. A gap formed between the ground side chip 61 and the discharge chip 31 serves as a discharge gap.

As shown in FIG. 1, an annular space SP is formed, inside the connection part 52, between the outer peripheral surface of the insulator 20 and the inner peripheral surface of the metal fitting 50. The annular space SP is a space having an annular shape and formed surrounding the center axis CX. An end portion in the tip end side of the annular space SP is partitioned by a protrusion 211 (see FIG. 2). An end portion in the rear end side of the annular space SP is partitioned by a caulking part 51 of the metal fitting 50. The caulking part 51 is positioned closer to a rear end side than the position of the connection part 52 in the metal fitting 50. The caulking part 51 is deformed towards the inner periphery side when being caulked.

A talc material which is powdered talcum is filled into the annular space SP. The talc material TC enhances the anti-shock properties of the ignition plug 10 in a state of being attached to the internal combustion engine and prevents the gas from the internal combustion engine from leaking towards the rear end side.

In the annular space SP, an annular member 90 is provided at an end portion in the rear end side along the center axis CX (i.e. opposite side of the center electrode 30). Further, in the annular space SP, a first annular member 81 and a second annular member 2 are provided in a state of being in contact with each other at an end portion in the tip end side along the center axis CX (i.e. the center electrode 30 side). Each of the annular member 90, the first annular member 81 and the second annular member 82 is formed in an annular shape to surround the center axis CX. For example, each of the annular member 90, the first annular member 81 and the second annular member 82 is made of hard metal material such as carbon steel. Each cross-sectional shape of the annular member 90, the first annular member 81 and the second annular member 82 which are sectioned at a surface including the center axis CX is a circular shape.

Thus, according to the present embodiment, a single annular member 90 is provided at a rear end side of the talc material TC, but a plurality of annular members (first annular member 81 and second annular member 82) are provided in the tip end side of the talc material TC. The reason of this arrangement will be described later.

A method of fixing the metal fitting 50 to the insulator 30 will be described. Firstly, the insulator 20 is inserted into the metal fitting 50 from the rear end side thereof. At this time, the caulking part 51 is not deformed yet as shown in FIG. 1, but linearly extends in the rear end side. In other words, the rear end side of the annular space SP is opened towards outside.

A protrusion 562 is formed on the inner peripheral surface of the insertion portion 56 of the metal fitting 50. The insulator 20 inserted inside the metal fitting 50 comes to stop in a state where a stepped portion formed on the outer periphery thereof is in contact with the protrusion 562. Thereafter, the first annular member 81, the second annular member 82, the talc material TC and the annular member 90 are arranged in the annular space SP in this order.

Next, force is applied between a bottom surface (surface to be contacted with gasket GK) of the flange portion 55 and a tip end of the caulking part 51 along the center axis CX to compress therebetween. With this force, the caulking part 51 is deformed to be displaced towards the inner periphery side as shown in FIG. 1.

Further, since the deformation portion 54 formed between the connection part 52 and the flange portion 55 is relatively thin, the deformation portion 54 is buckled. Thus, since the distance from the caulking part 51 to the protrusion 562 becomes shorter, with the force via the talc material TC, the insulator 20 is strongly pressed onto the protrusion 562. With the above method, the metal fitting 50 is caulked so as to support the insulator 20 from the outer periphery side of the ignition plug 10, thereby being fixed to the insulator 20.

In a state after the metal fitting 50 is caulked as shown in FIG. 1, compression force has been applied to the talc material TC. The talc material in this state absorbs vibrations from the internal combustion engine, thereby exhibiting a function to enhance the anti-shock properties of the ignition plug 10. Further, the talc material TC becomes denser due to the compression force, thereby exerting a function of sealing material to prevent the gas from internal combustion engine from leaking towards the rear end side.

Figure 2:
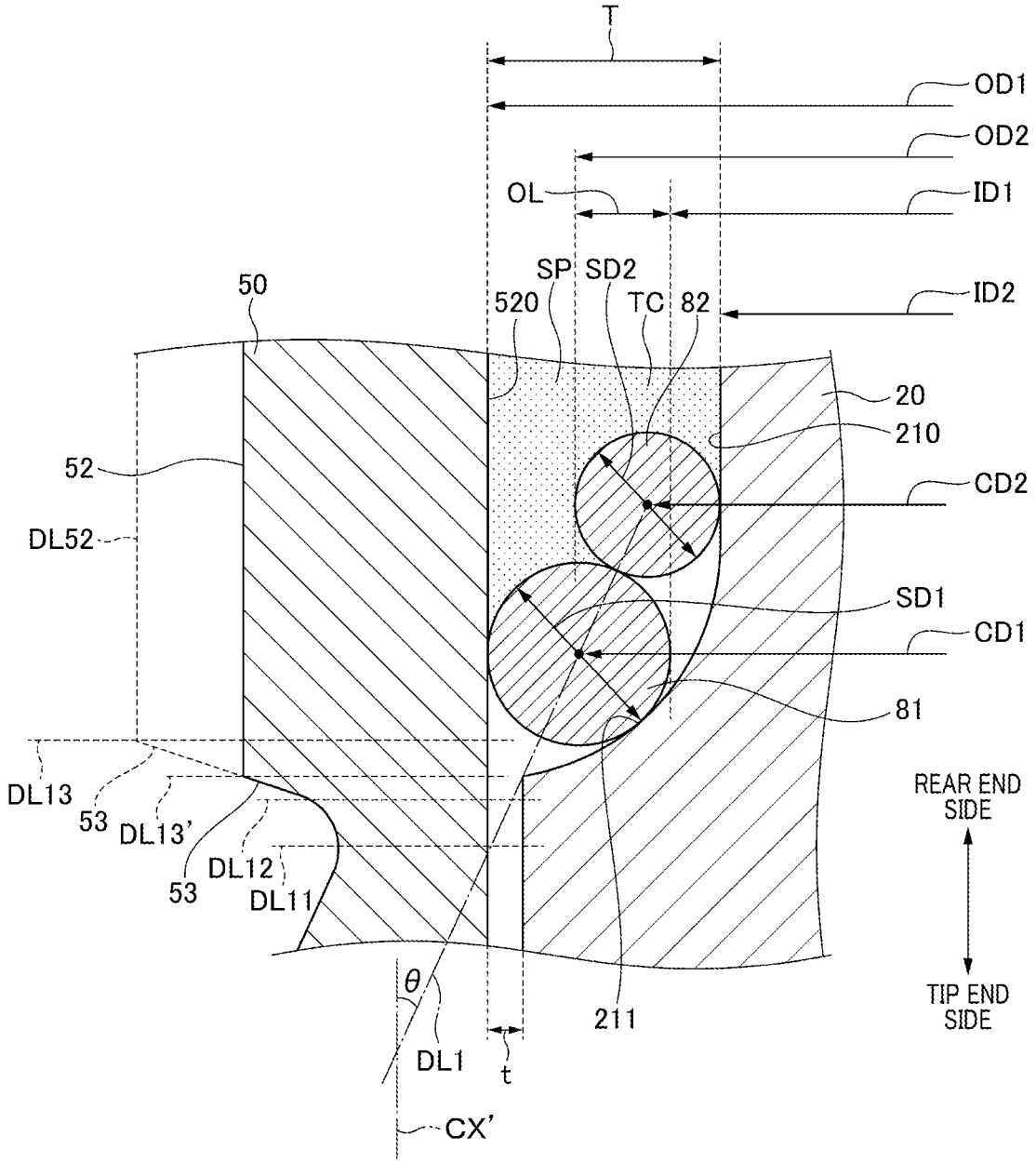
FIG. 2 is a diagram illustrating an enlarged part of the configuration shown in FIG. 1.

With reference to FIG. 2, the first annular member 81 and the second annular member 82, and a configuration in the vicinity of the first and second annular members 81 and 82 will be described. FIG. 2 is an enlarged diagram in which a part of FIG. 1 is enlarged. A portion to which reference number 210 is applied in FIG. 2 is an outer peripheral surface of the insulator 20. Hereinafter, the outer peripheral surface is also referred to as outer peripheral surface 210.

In the insulator 20, a protrusion 211 is formed at a portion in the vicinity of the end portion in the tip end side of the annular space SP. The protrusion 211 protrudes such that the closer to the tip end side along the center axis CX (i.e. center electrode 30 side), the larger the diameter of the outer peripheral surface 210. In the cross-section shown in FIG. 2, a line indicating the outer peripheral surface of the protrusion 211 an arc-shaped line protruding towards the tip end side. The protrusion 211 supports the first annular member 81 from the top end side. In a portion closer to the rear end side than the protrusion 211 is, the line indicating the outer peripheral surface 210 of the insulator 20 is a straight line extending in parallel to the center axis CX.

The first annular member 81 is provided closer to a tip end side than the position of the second annular member 82. The center diameter CD1 of the first annular member 81 is larger than the center diameter CD2 of the second annular member 82. The center diameter CD1 may be also referred to as a dimension equal to twice of a distance from the center of the cross-section of the first annular member 81 to the center axis CX as shown in FIG. 2. Moreover, the center diameter CD2 may be also referred to as a dimension equal to twice of a distance from the center of the cross-section of the second annular member 82 to the center axis CX as shown in FIG. 2.

In FIG. 2, a portion to which reference number 520 is applied is an inner peripheral surface of the metal fitting 50. Hereinafter, the inner peripheral surface may be also referred to as inner peripheral surface 520. In the cross section shown in FIG. 2, the line indicating the inner peripheral surface 520 of the metal fitting 50 is a straight line extending in parallel to the center axis CX.

'T' shown in FIG. 2 refers to a distance from the outer peripheral surface 210 to the inner peripheral surface 520 along a direction perpendicular to the center axis CX, that is, a width dimension of a portion different from the protrusion 211 in the annular space SP. T shown in FIG. 2 is a distance from the tip end of the protrusion 211 to the inner peripheral surface 520, that is, a width dimension of a gap formed in the tip end side of the protrusion 211.

In FIG. 2, the diameter SD1 of the cross-section the first annular member 81 is smaller than the above-described T and larger than the above-described t. Also, the first annular member 81 is in contact with both of the outer peripheral surface of the protrusion 211 and the inner peripheral surface 520 of the metal fitting 50. With this configuration, the talc material TC is prevented from being leaked from a portion between the first annular member 81 and the inner peripheral surface 520. Also, the first annular member 81 cannot be located in a portion formed in the tip end side of the protrusion 211.

The second annular member 82 is in a state of being in contact with the first annular member 81 from opposite side of the center electrode 30 (i.e. from rear end side). In FIG. 2, the diameter SD2 of the cross-section of the second annular member 82 is smaller than the diameter SD1 of the cross-section of the first annular member 81. However, as long as an overlapped width OL which will be described later is within a predetermined range, the diameter SD2 may be larger than the diameter SD1, or the diameter SD1 and the diameter SD2 are the same.

The second annular member 82 is in contact with both the first annular member 81 and the outer peripheral surface 210. Note that, a portion in the outer peripheral surface 210, which the second annular member 82 contacts, may be in a region where the protrusion 211 is not formed or in a range where the protrusion 211 is formed.

ID1 shown in FIG. 2 indicates an inner diameter of the first annular member 81. Hereinafter, this inner diameter may be referred to as inner diameter ID1. The inner diameter ID1 may be also referred to as a dimension equal to twice a distance from a portion in the most inner periphery side of the first annular member 81 to the center axis CX.

OD1 shown in FIG. 2 indicates an outer diameter of the first annular member 81. Hereinafter, this outer diameter may be referred to as outer diameter OD1. The outer diameter OD1 may be also referred to as a dimension equal to twice a distance from a portion in the most outer periphery side of the first annular member 81 to the center axis CX. According to the present embodiment, the outer diameter OD1 equals the inner diameter of the inner peripheral surface 520.

ID2 shown in FIG. 2 indicates an inner diameter of the second annular member 82. Hereinafter, this inner diameter may be referred to as inner diameter ID2. The inner diameter ID2 may be also referred to as a dimension equal to twice a distance from a portion in the most inner periphery side of the second annular member 82 to the center axis CX. According to the present embodiment, the inner diameter ID2 equals an outer diameter of a portion of the outer peripheral surface 210 in which the protrusion 211 is not formed.

OD2 shown in FIG. 2 indicates an outer diameter of the second annular member 82. Hereinafter, this outer diameter may be referred to as outer diameter OD2. The outer diameter OD2 may be also referred to as a dimension equal to twice a distance from a portion in the most outer periphery side of the second annular member 82 to the center axis CX.

According to the present embodiment, the outer diameter OD2 of the second annular member 82 is larger than the inner diameter ID1 of the first annular member 81. Hence, when viewed along the center axis CX, a part of the first annular member 81 and a part of the second annular member 82 are overlapped. The overlapped width OL shown in FIG. 2 refers to a width of a portion in the above overlapped portion along a direction perpendicular to center axis CX. The overlapped width OL may be also referred to, in a cross-section of the ignition plug 10 sectioned along a surface including the center axis CX, as a distance from a portion in the most inner periphery side of the first annular member 81 to a portion in the most outer periphery side of the second annular member 82 along a direction perpendicular to the center axis CX. The overlapped width OL equals to a half of a dimension in which the inner diameter ID1 is subtracted from the outer diameter OD2. According to the configuration of the present embodiment, the overlapped width OL equals to a value calculated by an equation (SD2−(T-SD1)).

A dash-dot chain line DL1 shown in FIG. 2 is a virtual line which passes through both the center of the cross-section of the first annular member 81 and the center of the cross-section of the second annular member 82. Also, in FIG. 2, a dash-dot chain line CX' is a straight line parallel to the center axis CX (not shown). An angle θ shown in FIG. 2 is an angle formed between the dash-dot chain line DL1 and the dash-dot chain line CX'. The angle θ may be also referred to as an angle formed between the straight line which connects the center of the cross-section of the first annular member 81 and the center of the cross-section of the second annular member 82, and the center axis CX.

The cross-section shown in FIG. 2 is a cross-section of the ignition plug 10 which is sectioned along a surface perpendicular to both of the two faces mutually facing each other in the connection part 52, and including the center axis CX. Further, the dotted line DL 52 shown in FIG. 2 indicates an outline of the connection part 52 in the cross-section of the ignition plug 10 sectioned along a surface through the apex of the hexagonal shaped connection part 52 including the center axis CX.

In the metal fitting 50, a portion adjacent to the connection part 52 in the tip end side, that is, a portion labeled as reference number 53, is formed such that the closer to the tip end side along the center axis CX, the smaller the diameter of the outer peripheral surface of the metal fitting 50 is. Hereinafter, this portion may be referred to as reduced portion. The dotted line DL13 shown in FIG. 13 indicates, in the reduced portion, an apex position of the hexagonal part which is positioned at the most rear end side along the center axis CX, that is, a portion in the most rear end side in the reduced portion 53 in the cross-section indicated by the above dotted line DL 52. Furthermore, the dotted line DL13' shown in FIG. 2 indicates, in the reduced portion 53, a hexagonal plane part which is positioned at the most rear end side along the center axis CX, that is, a portion in the most rear end side in the reduced portion 53 in the cross-section shown in FIG. 2.

The reduced portion 53 is formed extending up to a position indicated by the dotted line DL11 shown in FIG. 2. In a portion further to the tip end side than the dotted line DL 11, the diameter of the outer peripheral surface of the metal fitting 50 is set such that the closer to the tip end side along the center axis CX, the larger the diameter is. This portion further to the tip end side than the dotted line DL 11 is connected to the deformation portion 54 shown in FIG. 1. In other words, the dotted line DL11 may be referred to as a line indicating a portion in the most tip end side along the center axis CX. In the cross-section shown in FIG. 2, the line indicating the outer peripheral surface of the reduced portion 53 is arc-shaped curve in a range from the dotted line DL11 to the dotted line DL12. The line indicating the outer peripheral surface of the reduced portion 53 is a straight in a range from the dotted line DL 12 to the dotted line DL 13.

Figure 3A:
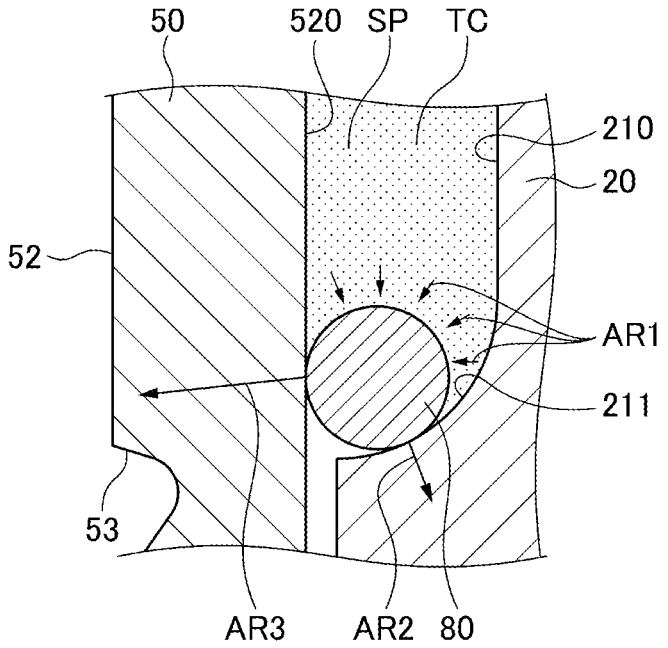
FIGS. 3A and 3B are diagrams each illustrating force applied to a metal fitting from an annular member in an ignition plug according to a comparative example.
Figure 3B:
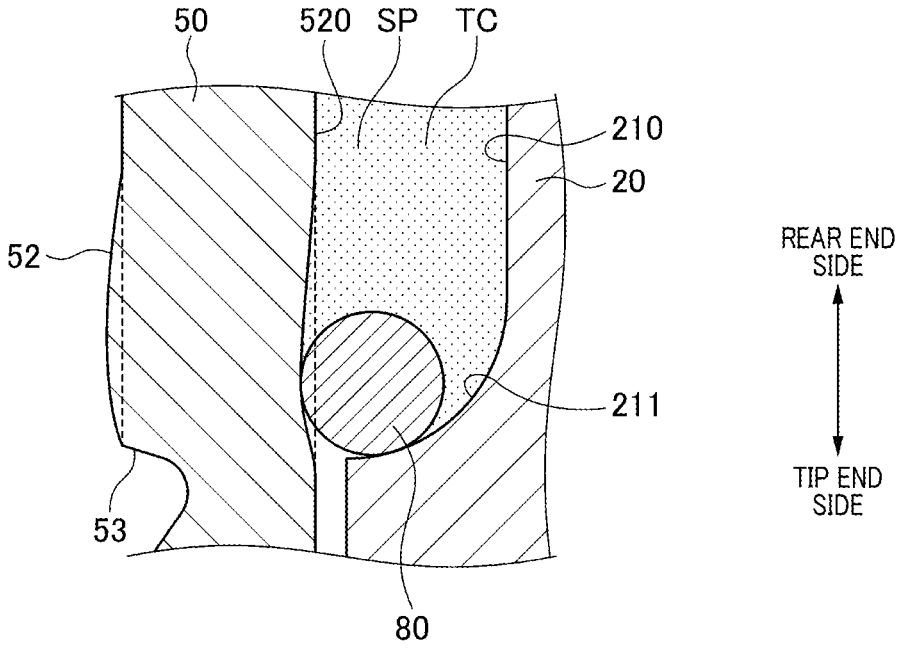

In the present embodiment, firstly, a comparative example which is similar to conventional art will be described in order to explain advantages of the two annular members (i.e. first annular member 81 and the second annular member 82) arranged in the tip end side of the talc material TC. As shown in FIGS. 3A and 3B, according to the comparative example, only a single annular member 80 is provided in the tip end side of the talc material TC. Configurations other than this comparative example are the same as those in the present embodiment shown in, for example FIG. 2.

FIG. 3A illustrates a state immediately after the metal fitting 50 is caulked. As described above, when the metal fitting 50 is caulked, compression force is applied to the talc material TC. Hence, the annular member 80 receives force in a direction towards the tip end side from the talc material TC. In FIG. 3A, the force applied to the annular member 80 from the talc material TC is indicated by a plurality of arrows AR1.

The force from the talc material TC presses the annular member 80 onto the protrusion 211. Hence, the protrusion 211 receives force in a direction from the annular member 80 substantially towards the tip end side. The arrow AR2 shown in FIG. 3A indicates the force applied to the protrusion 211 from the protrusion 211.

The talc material TC is also present at a portion between the annular member 80 and the protrusion 211. In addition to the force in a direction towards the tip end side, the annular member 80 receives force in a direction from the talc material which is present between the annular member 80 and the protrusion 211 towards the metal fitting 50 in the outside thereof. Hence, the inner peripheral surface 520 of the metal fitting 50 receives force in a direction from the annular member 80 substantially towards the outer periphery side. The arrow shown in FIG. 3A indicates force applied to the inner peripheral surface 520 from the annular member 80.

The protrusion 211 is inclined such that the closer to the tip end side along the center axis CX, the larger the diameter of the outer peripheral surface 210. Hence, since the annular member 80 pressed onto the protrusion 211 is made to move outward along the protrusion 211, the annular member 80 is further pressed strongly on the inner peripheral surface 520 of the metal fitting 50. The direction of force indicated by the arrow AR3 is substantially the same as the direction of a tangential line (not shown) which touches a portion in contact with the annular member 80 in the protrusion 211.

As described, the annular member 80 received force from the talc material TC applies force to the metal fitting 50 in a direction to be expanded outside. According to the comparative example, the reduced portion 53, that is, a portion of the metal fitting 50 having small thickness is present in the vicinity of a portion applied with force from the annular member 80 in the metal fitting 50. This structure is similar to that of the present embodiment. Hence, when the force indicated by the arrow AR3 due to the caulking becomes larger, the metal fitting 50 may be deformed as shown in FIG. 3B. In an example shown in FIG. 3B, the outer peripheral surface of the contact portion 52 is deformed to slightly swell outward. In FIG. 3B, the shape of the metal fitting 50 before being deformed is indicated by a dotted line.

Such a deformation of the metal fitting 50 may cause a problem in which the tool cannot be engaged with the connection part 52 when attaching the ignition plug to the internal combustion engine. Further, since the talc material TC is softened in association with the deformation of the metal fitting 50, the sealing performance of the talc material is degraded such that the gas from the internal combustion engine may be leaked towards outside through the talc material TC.

Figure 4:
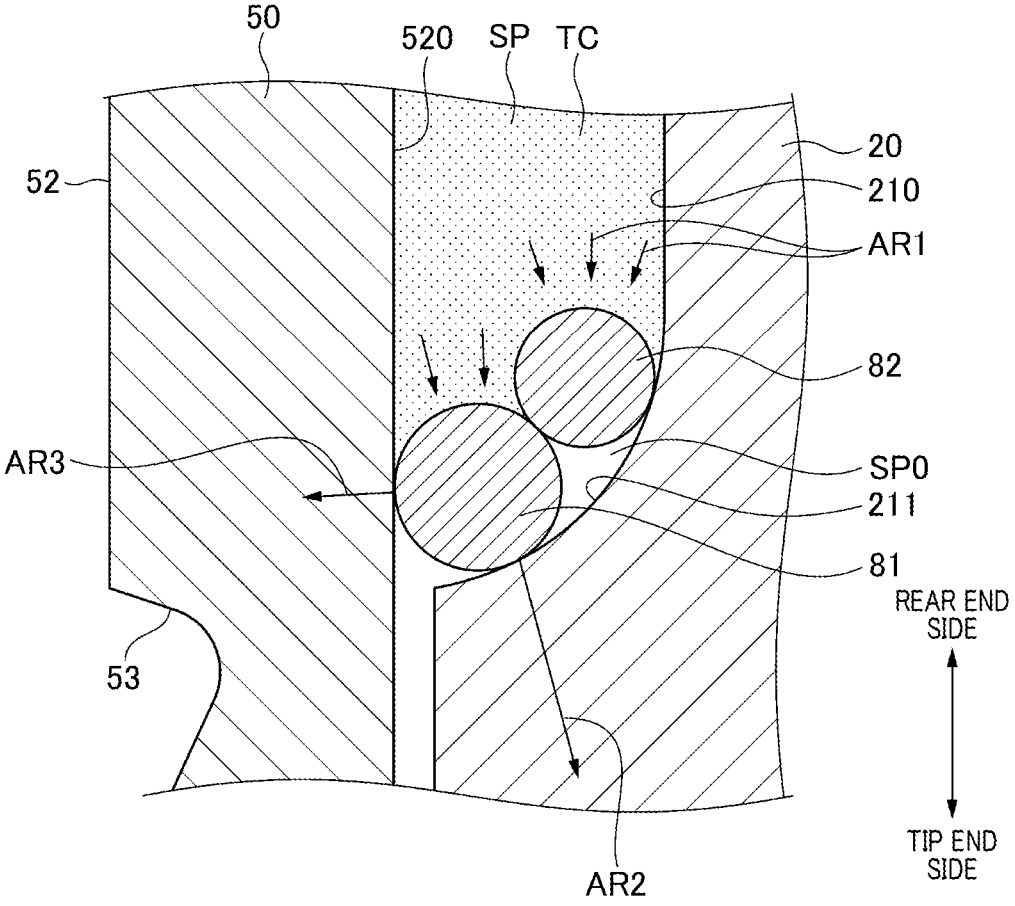
FIG. 4 is a diagram illustrating force applied to a metal fitting from an annular member in an ignition plug according to the present embodiment.

For this reason, according to the present embodiment, the first annular member 81 and the second annular member 82 are arranged to be overlapped with each other below the talc material TC, thereby preventing the metal fitting 50 from being deformed when being caulked. FIG. 4 illustrates, with a method similar to that of FIG. 3A, a state immediately after the metal fitting 50 according to the present embodiment is caulked.

Figure 5:
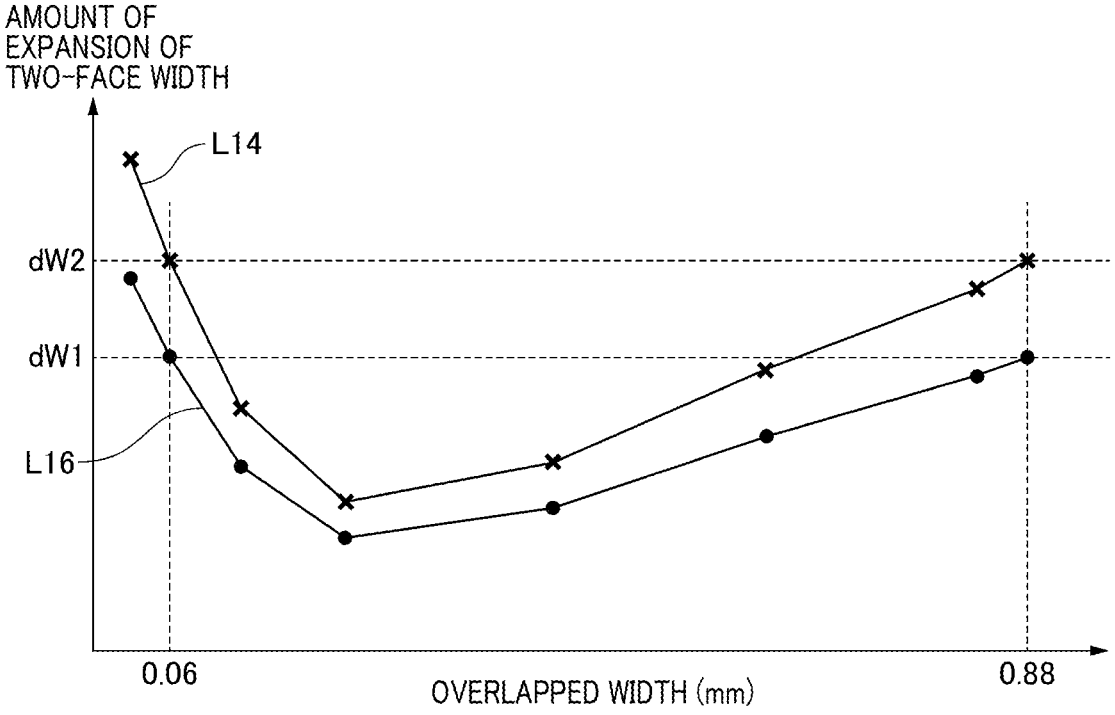
FIG. 5 is a graph illustrating a relationship between an overlap width between a first annular member and a second annular member, and an amount of expansion of a two-face width in a connection part.

Also, according to the present embodiment, similar to the comparative example shown in FIG. 5, when the metal fitting 50 is caulked, the first annular member 81 and the second annular member 82 each receives a force in a direction from the talc material TC towards the tip end side (indicated by arrow AR1). With this force, the first annular member 81 is pressed onto the protrusion 211.

As shown in FIG. 4, according to the configuration of the present embodiment, the second annular member 82 is in contact with the first annular member 81 from the rear end side and the inner peripheral side. Hence, since an inner peripheral portion of the first annular member 81 in the annular space SP (i.e. portion labeled as SPO) is covered by the second annular member 82 from the rear end side, the talc material TC is not present in the inner peripheral portion of the first annular member 81. Accordingly, a magnitude of the force from the talc material TC towards the outer periphery side, which is received by the second annular member 82, is smaller than that of the comparative example as shown FIG. 3A. As a result, the force applied to the inner peripheral surface 520 from the first annular member 81 (arrow AR3) is also smaller than that of the comparative example shown in FIG. 3A.

Note that, according to the present embodiment, the first annular member 81 is strongly pressed onto the protrusion 211 by the force from the second annular member 82 which is provided in the rear end side. Therefore, the force applied to the protrusion 211 from the first annular member 81 (arrow AR2) is larger than that of the comparative example shown in FIG. 3A.

Thus, according to the present embodiment, the first annular member 81 and the second annular member 82 are arranged to be overlapped with each other below the talc material TC, thereby chaining the balance of forces indicated by the arrow AR2 and arrow AR3. As a result, the force applied to the inner peripheral surface 520 from the first annular member 81 can be suppressed compared to the conventional art, and the deformation of the metal fitting 50 can be suppressed compared to the conventional art.

The magnitude of the force applied to the inner peripheral surface 520 from the first annular member 81 changes depending on respective shapes of the first annular member 81 and the second annular member 82. The inventors of the present disclosure have found, through experiments for various shapes of the first annular member 81 and the second annular member 82, that the above magnitude of force changes depending on the above-described overlapped width OL (See FIG. 2).

FIG. 5 illustrates a relationship between the overlapped width OL (horizontal axis) and an amount of expansion of a two-face width (vertical axis). The amount of expansion of the two-face width refers to an amount of increase in the two-face width of the connection part 52 when the metal fitting 50 is caulked to be fixed to the insulator 20. FIG. 5 is a graph in which an amount of increase in the doble face width of the connection part 52 is plotted under a condition where the diameter SD1 of the first annular member 81 is fixed to be 1 mm and the diameter SD2 of the second annular member 82 is changed to be various values. In the respective measurements, the first annular member 81 is in contact with the inner peripheral surface 520 of the metal fitting 50 and the second annular member 82 is in contact with the outer peripheral surface 210 of the insulator 20.

The line 16 shown in FIG. 5 indicates measurement values of the amount of expansion of the two-face width for the samples having the initial two-face width of 16 mm of the connection part 52. The dW1 shown in FIG. 5 indicates the amount of expansion of the two-face width for the samples configured similar to that of the comparative example shown in FIG. 3 having the initial two-face width of 16 mm of the connection part 52. As shown in FIG. 5, in the case where the overlapped width OL is in a range from 0.06 mm to 0.88 mm, the amount of expansion of the two-face width is the conventional value (dW1) or less.

When the overlapped width OL is 0.06 mm and 0.88 mm, the amount of expansion of the two-face width are the same value as the conventional value (dW1).

The line 14 shown in FIG. 5 indicates measurement values of the amount of expansion of the two-face width for the samples having the initial two-face width of 14 mm of the connection part 52. The dW2 shown in FIG. 5 indicates the amount of expansion of the two-face width for the samples configured similar to that of the comparative example shown in FIG. 3 having the initial two-face width of 14 mm of the connection part 52. Also in this case, in the case where the overlapped width OL is in a range from 0.06 mm to 0.88 mm, the amount of expansion of the two-face width is the conventional value (dW2) or less. When the overlapped width OL is 0.06 mm and 0.88 mm, the amount of expansion of the two-face width are the same value as the conventional value (dW2).

Figure 6A:
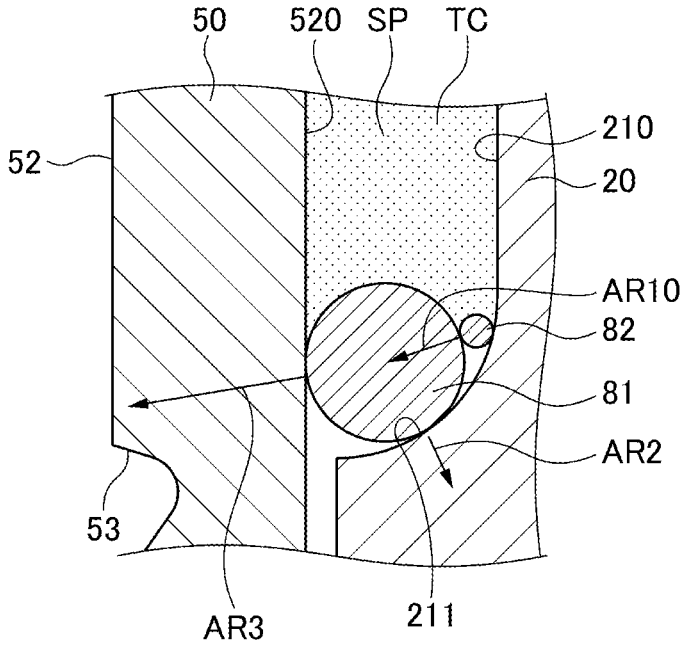
FIGS. 6A and 6B are diagrams each illustrating force applied to a metal fitting from an annular member in an ignition plug according to a comparative example.

In the case where the overlapped width is smaller than 0.06 mm, the amount of expansion of the two-face width becomes larger than that of the conventional art. The reason of this is as follows. In this case, as shown in FIG. 6A, the second annular member 82 is positioned deeply inside between the first annular member 81 and the protrusion 211. Thus, the force applied to the first annular member 81 by the second annular member 82 is, as indicated by the arrow AR10, a vertical directional component with respect to the center axis CX becomes large. As a result, the first annular member 81 is strongly pressed onto the inner peripheral surface 520 by the arrow AR3 and may cause an increase in the amount of expansion of the two-face width.

Figure 6B:
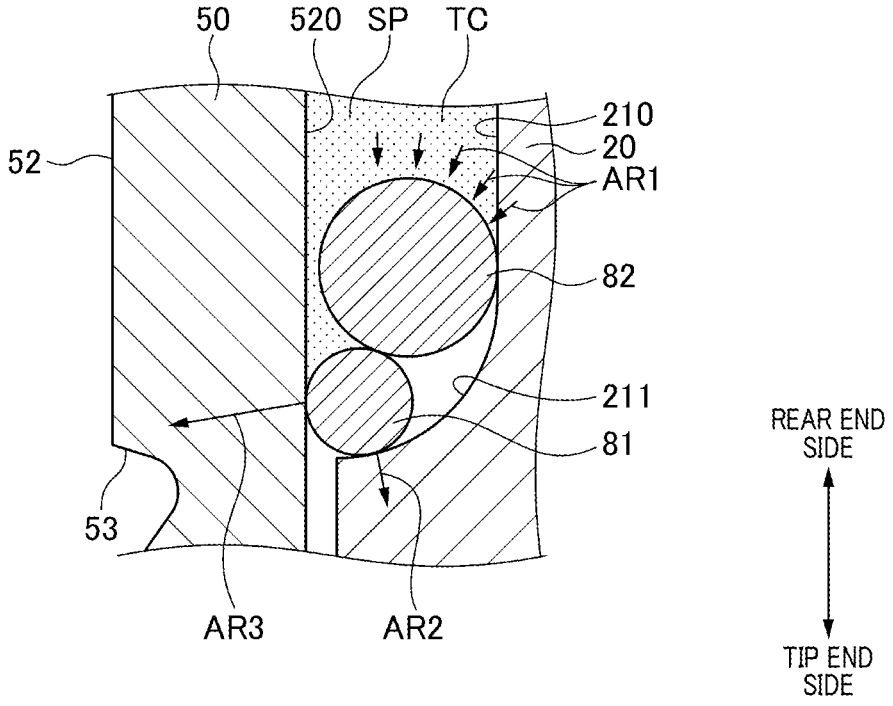

Also, when the overlapped width OL is larger than 0.88 mm, the amount of expansion of the two-face width becomes larger than that of the conventional art. The reason of this is as follows. In this case, as shown in FIG. 6B, a gap between the second annular member 82 and the outer peripheral surface 210 becomes wider and the talc material TC is filled in the gap. Thus, the talc material TC filled in the gap applies force to the second annular member 82 in a direction towards the metal fitting 50 positioned outside. The force is transferred to the inner peripheral surface 520 via the first annular member 81 and may cause an increase in the amount of expansion of the two-face width. As described, respective shapes of the first annular member 81 and the second annular member 82 are adjusted such that the overlapped width OL is in a range from 0.06 mm to 0.88 mm, whereby the deformation of the connection part 52 can be suppressed. The above-described range of the overlapped width OL is the same as the case where the diameter of the first annular member 81 is set to be values other than 1 mm. Also, the same applies to a case where the cross-sectional shape of at least either the first annular member 81 or the second annular member 82 is not circular shape.

Figure 7:
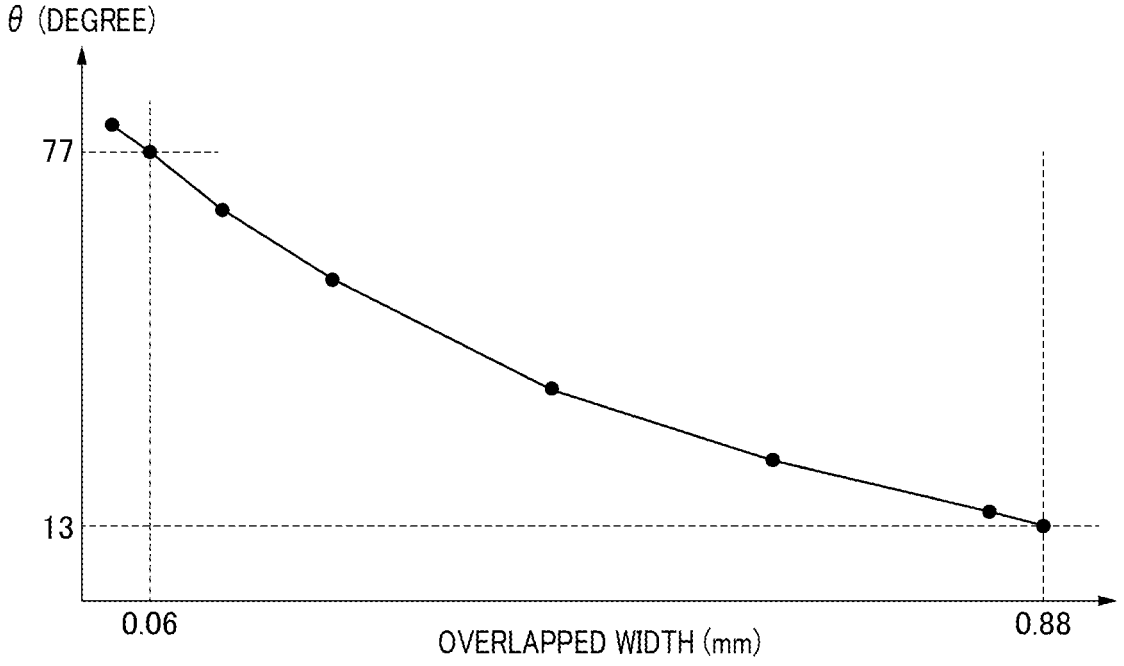
FIG. 7 is a graph illustrating a relationship between an overlap width between a first annular member and a second annular member, and an angle θ.

Note that, according to the present embodiment, in the case where cross-sectional shapes of the first annular member 81 and the second annular member 82 is circular shape, the above-range of the overlapped width OL can be expressed as an angle θ shown in FIG. 2. FIG. 7 illustrates a relationship between the overlapped width OL (horizontal axis) and the angle θ (vertical axis). The configuration in which the overlapped width OL is 0.06 mm corresponds to a configuration having 77° of the angle θ. Hence, when adjusting the shapes of the first annular member 81 and the second annular member 82 such that the angle θ ranges from 13° to 77°, the deformation of the connection part 52 can be suppressed compared to that of the conventional art.

Note that, when the two-face width of the connection part 52 is larger than 16 mm, since the rigidity of the connection part 52 or a portion in the vicinity of the connection part 52 is high, less effects and advantages are obtained from the configuration in which the first annular member 81 and the second annular member 82 are overlapped. On the other hand, when the two-face width of the connection part 52 is less than or equal to 16 mm, even though it is reduced in size thereof, the rigidity of the connection part 52 or a portion in the vicinity thereof is lowered. In this regard, with the configuration of the present embodiment, significant effects and advantages can be obtained. Thus, the configuration of the present embodiments may preferable be applied to an ignition plug 10 provided with the connection part 52 in which the two-face width is less than or equal to 16 mm.

Figure 8:
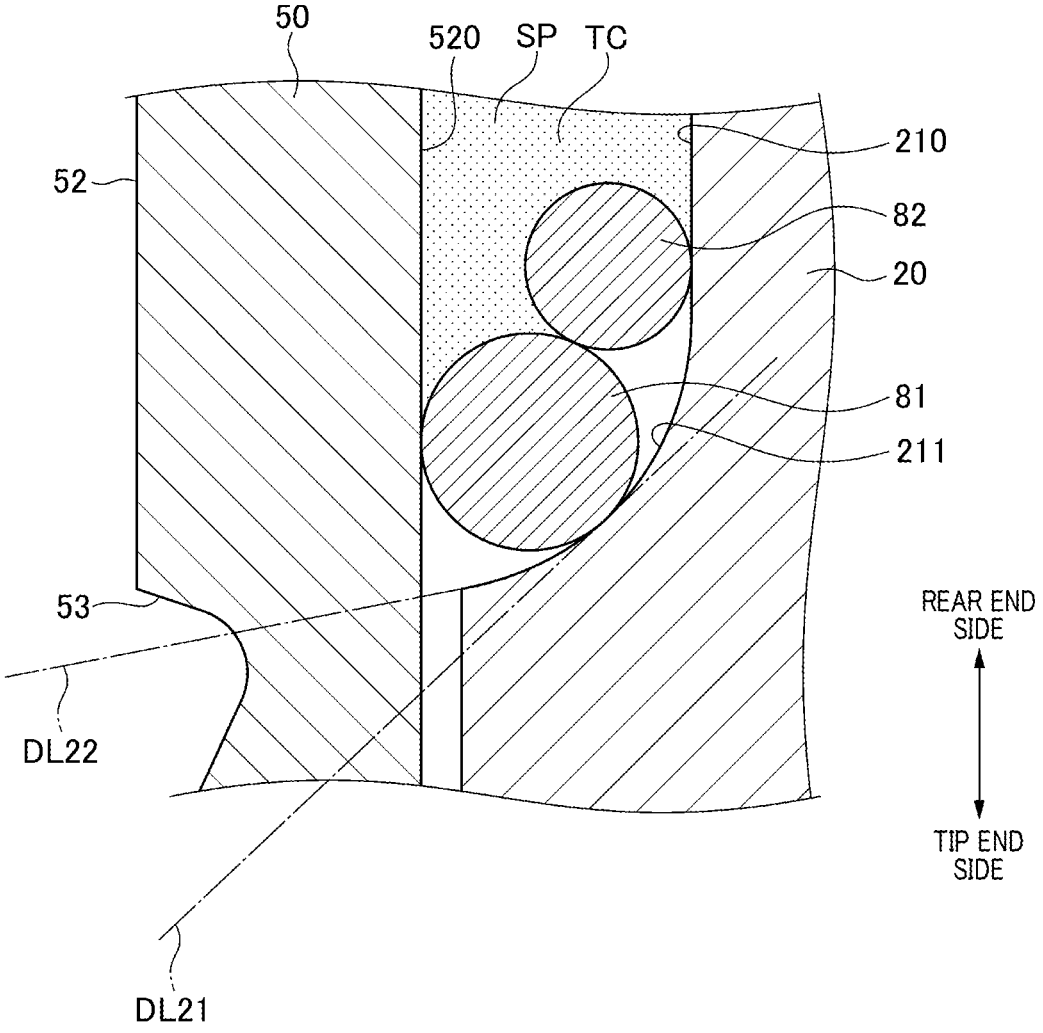
FIG. 8 is a diagram illustrating a position where the connection part is provided.

FIG. 8 illustrates a cross-section of the ignition plug 10 according to the present embodiment with the same view as that of FIG. 2. The dash-dot chain line DL21 shown in FIG. 8 indicates a tangential line which touches a portion with which the first annular member 81 is in contact in the protrusion 211.

When the metal fitting 50 is caulked, the first annular member 81 tends to expand along the outer peripheral surface of the protrusion 211. Hence, the direction of the force applied to the inner peripheral surface 520 from the first annular member 81 is a direction along the dash-dot chain line DL21 as the tangential line.

Assuming that the entire reduced portion is positioned further on the tip end side than the portion indicated by the dash-dot chain line DL21, since most of the force along the dash-dot chain line DL21 is applied to a portion having high rigidity (connection part 52), deformation of the metal fitting 50 including the connection part 52 is unlikely to occur. In this case, even if the configuration of the present disclosure in which the first annular member 81 and the second annular member 82 are overlapped is employed, less effects is obtained.

On the other hand, as shown in FIG. 8, according to the present embodiment, at least part of the reduced portion 53 is provided further on the rear end side than the portion indicated by the dash-dot chain line DL21. In other words, the connection part 52 according to the present embodiment is formed at a portion further on the rear end side than the portion indicated by the dash-dot chain line DL21. With this configuration, since the force along the dash-dot chain line DL21 is applied to a portion (reduced portion 53) having low rigidity in the metal fitting 50, this portion is likely to be deformed. Hence, the connection part 52 is also likely to be deformed. Accordingly, with this configuration, significant effects can be obtained when utilizing the configuration of the present embodiment in which the first annular member 81 and the second annular member 82 are overlapped.

The dash-dot chain line DL22 indicates a tangential line at a portion in the most outer periphery side of the protrusion 211, that is, a virtual line when the shape of the protrusion further extends towards the outer periphery side. According to the present embodiment, at least part of the reduced portion 53 is provided further on the rear end side than the portion indicated by the dash-dot chain line DL22. In this case, even when the first annular member 81 is in contact with any positions in the protrusion 211, at least a part of the reduced portion 53 is always positioned further on the real end side than the portion indicated by the dash-dot chain line DL21. Therefore, as described above, significant effects can be obtained when utilizing the configuration of the present embodiment in which the first annular member 81 and the second annular member 82 are overlapped.

In the above-described embodiments, a case is exemplified in which each cross-sectional shape of the first annular member 81 and the second annular member 82 is circular. However, at least either cross-sectional shape may a shape other than circular shape. Even in this case, the outer diameter of the second annular member 82 is set to be larger than the inner peripheral surface of the first annular member 81, and the overlapped width OL is set within a range from 0.06 mm to 0.88 mm, whereby deformation of the connection part 52 can be suppressed.

In the above-described embodiments, a case is exemplified in which the center diameter CD1 of the first annular member 81 is larger than the center diameter CD2 of the second annular member 82. However, it is not limited to this configuration, but the center diameter CD1 of the first annular member 81 may be set to be smaller than the center diameter CD2 of the second annular member 82. Even with this configuration, the force applied to the inner peripheral surface from the second annular member 82 is made to be changed, whereby the deformation of the connection part 52 can be suppressed.

The plurality of annular members arranged below the talc material TC may include another annular members in addition to the first annular member 81 and the second annular member 82. Specifically, three or more annular members may be provided below the talc material TC.

The present embodiment with reference to specific examples has been described. However, the present disclosure is not limited to these specific examples. The present disclosure may include configurations to which person skilled in the art applies modification of the above specific examples as long as the features of the present disclosure are included. Elements, arrangements, condition and shapes thereof included in the respective specific examples are not limited to the exemplified configurations, but may be appropriately modified. The respective elements included in the above-described specific examples can be appropriately combined as long as technical inconsistency is not present.

CONCLUSION

The present disclosure provides an ignition plug capable of suppressing deformation of the metal fitting.

An ignition plug according to the present disclosure incudes: an insulator provided with a shaft hole formed therein; a center electrode supported by the insulator at an one end portion of the shaft hole along a center axis thereof; a metal fitting caulked to support the insulator from an outer periphery side thereof; a ground electrode extending from the metal fitting, a part of the ground electrode facing the center electrode; and a talc material filled in an annular space provided between an outer peripheral surface of the insulator and an inner peripheral surface of the metal fitting.

A first annular member and a second annular member are provided at an end portion of the annular space, the end portion being positioned in a center electrode side along the center axis in the annular space, the second annular member being in contact with the first annular member from an opposite side of the center electrode.

In the ignition plug configured as described above, a first annular member and a second annular member are provided at an end portion of the annular space, the end portion being positioned in a center electrode side along the center axis in the annular space, the second annular member is in contact with the first annular member from an opposite side of the center electrode. With this configuration, compared to a conventional configuration in which a single annular member is provided at the above position, force applied to the metal fitting from the annular member is suppressed. As a result, deformation of the metal fitting can be suppressed compared to the conventional art.

According to the present disclosure, an ignition plug capable of suppressing the deformation of the metal fitting can be provided.

What is claimed is:

1. An ignition plug comprising:

an insulator provided with a shaft hole formed therein;

a center electrode supported by the insulator at an one end portion of the shaft hole along a center axis thereof;

a metal fitting caulked to support the insulator from an outer periphery side thereof;

a ground electrode extending from the metal fitting, a part of the ground electrode facing the center electrode; and a talc material filled in an annular space provided between an outer peripheral surface of the insulator and an inner peripheral surface of the metal fitting, wherein a first annular member and a second annular member are provided at an end portion of the annular space, the end portion being positioned in a center electrode side along the center axis in the annular space, the second annular member being in contact with the first annular member from an opposite side of the center electrode.

2. The ignition plug according to claim 1, wherein a center diameter of the first annular member is larger than a center diameter of the second annular member.

3. The ignition plug according to claim 1, wherein an inner diameter of the first annular member is larger than an outer diameter of the second annular member.

4. The ignition plug according to claim 3, wherein an overlapped width is defined as, in a cross-section of the ignition plug sectioned along a surface including the center axis, a distance from a portion in the most inner periphery side of the first annular member to a portion in the most outer periphery side of the second annular member along a direction perpendicular to the center axis;

the overlapped width is in a range from 0.06 mm to 0.88 mm.

5. The ignition plug according to claim 3, wherein each cross-sectional shape of the first annular member and the second annular member in a cross-section of the ignition plug sectioned along a surface including the center axis is a circular shape;

an angle (θ) formed between a straight line which connects a center of the cross-section of the first annular member and a center of the cross-section of the second annular member, and the center axis is in a range from 13° to 77°.

6. The ignition plug according to claim 1, wherein the metal fitting includes a connection part in an outer periphery side of the annular space, which allows a tool to be engaged thereto when the ignition plug is attached; and a width between two faces which face with each other in the connection part is 16 mm.

7. The ignition plug according to claim 1, wherein the metal fitting includes a connection part in an outer periphery side of the annular space, which allows a tool to be engaged thereto when the ignition plug is attached;

the insulator includes a protrusion that protrudes such that the closer to a center electrode side along the center axis, the larger a diameter of an outer peripheral surface thereof is, the protrusion supporting the first annular member from the center electrode side; and the connection part is formed at a portion further on an opposite side to the center electrode than a tangential line touching with a portion in the protrusion which is in contact with the first annular member.

* * * * *